US005381361A

United States Patent [19]

Kirk et al.

[11] Patent Number: 5,381,361

[45] Date of Patent: Jan. 10, 1995

[54] METHOD AND APPARATUS FOR REAL-TIME CONSTRAINT SOLUTION

[75] Inventors: David B. Kirk, South Pasadena; Alan H. Barr, Pasadena, both of Calif.

[73] Assignee: California Institute of Technology, Pasadena, Calif.

[21] Appl. No.: 61,848

[22] Filed: May 14, 1993

[51] Int. Cl.[6] ..... G06G 7/00

[52] U.S. Cl. ..... 364/807; 364/148

[58] Field of Search ..... 364/807, 148, 153, 551.01, 364/468, 489, 490, 735; 371/68.3, 69.1

[56] References Cited

U.S. PATENT DOCUMENTS

| | | | |
|---|---|---|---|
| 4,916,696 | 4/1990 | Funakubo | 371/68.3 |
| 4,935,702 | 6/1990 | Mead et al. | 330/9 |
| 5,068,622 | 11/1991 | Mead et al. | 330/253 |
| 5,150,367 | 9/1992 | Tong et al. | 364/153 |
| 5,282,128 | 1/1994 | Braude | 364/148 |

OTHER PUBLICATIONS

Kirk, David B., Kurt Fleischer, Lloyd Watts, and Alan Barr, "Constrained Optimization applied to the Parameter Setting Problem for Analog Circuits," Neural Information Processing Systems 4, Morgan Kaufman, Palo Alto, Calif., 1992.

Denyer, Peter B., and John Mavor, "Most Transconductance Multipliers for Array Applications," IEEE Proceedings, vol. 128, Pt. I, No. 3, pp. 81–86, Jun. 1981.

Denyer, Peter B., Colin, F. N. Cowan, John Mavor, Christopher B. Clayton, and John L. Pennock, "A Monolithic Adaptive Filter," IEEE Journal of Solid-State Circuits, vol. SC-18, No. 3, pp. 291–296, Jun. 1983.

Babanezhad, Joseph N., and Gabor C. Temes, "A 20-V Four-Quadrant CMOS Analog Multiplier," IEEE Journal of Solid-State Circuits, vol. SC-20, No. 6, pp. 1158–1168, Dec. 1985.

Mead, C. A., "Analog VLSI and Neural Systems," Addison-Wesley,pp. 233–242, 1989.

Tsividis, Yannis, Mihai Banu, and John Khoury, "Continuous-Time MOSFET-C Filters in VLSI," IEEE Transactions on Circuits and Systems, vol. CAS-33, No. 2, pp. 125–140, Feb. 1986.

*Primary Examiner*—Tan V. Mai

*Attorney, Agent, or Firm*—Blakely, Sokoloff, Taylor & Zafman

[57] ABSTRACT

A circuit and method for executing real time constraint solution permits real time control of computational tasks using analog very large scale integrated (VLSI) circuits. The constraints of a computation or task are first defined as a function or set of functions. The function(s) are used to produce an error measure function which described how well the constraint(s) is/are stisfied. Analog gradient descent techniques are then used to minimize the error measure function and produce an improved output of the task and optionally adjust the performance of the task. As this is performed in analog VLSI, the constraint solution can be performed continuously and continually in real time, without the limitations of discrete optimization as implemented using digital processing.

22 Claims, 8 Drawing Sheets

METHOD AND APPARATUS FOR REAL-TIME CONSTRAINT SOLUTION

BACKGROUND OF THE INVENTION

1. Field of the Invention

The method and apparatus of the present invention relates to a constraint solution technique and analog VLSI implementation of the same.

2. Art Background

There has been increasing interest recently in using analog VLSI for a variety of computational tasks. See, for example, Carver Mead, *Analog VLSI and Neural Systems* (Addison Wesley, 1989). Mead teaches that analog CMOS VLSI chips can be produced using standard digital CMOS VLSI processes instead of developing an entirely new manufacturing technology for producing analog VLSI chips. A key element in this strategy is to produce designs that are tolerant to device variations that are present in a digital VLSI production process.

Related research is focused on increasing the accuracy and precision of computation with analog VLSI and developing a design methodology for creating analog VLSI circuits which can be adjusted to perform the desired accuracy. See, for example, David Kirk, Kurt Fleischer, Alan Barr, and Lloyd Watts, "Constrained Optimization Applied to the Parameter Setting Problem for Analog Circuits," IEEE Neural Information Processing Systems, 1991 (NIPS 91), (Morgan Kaufman, 1991). These techniques make analog VLSI more tractable for quantitative computation. Although constraints can be determined using digital circuitry, there are distinct advantages achieved by implementing the circuit in analog VLSI. One advantage of analog VLSI is that it can be used to compute approximate solutions to problems very quickly, though some amount of accuracy and precision is traded for speed of computation. An analog circuit has the advantage of performing computations continuously and continually in real time in order to provide an effective solution. Furthermore, problems realized using digital circuitry, such as discretization and quantization errors are avoided.

SUMMARY OF THE INVENTION

The present invention provides a method and apparatus for a general constraint solution technique to be implemented in analog VLSI, which provides continuous real time computation of solutions to constraint problems. To implement constraints as a computation or a task, the problem is posed as an equation to be solved. Once the equation to be solved is determined, gradient descent or other optimization techniques are employed to rapidly converge to minimize the function. This can be implemented in analog VLSI, which provides numerous benefits including continuous and continual real time operation and does not suffer from the problems of digital implementation.

BRIEF DESCRIPTION OF THE DRAWINGS

The objects, features and advantages of the present invention will become apparent to one skilled in the art from reading the following detailed description in which.

FIGS. *7a* and *7b* are block diagram illustrations of embodiments of gradient descent processes.

Figure 8:
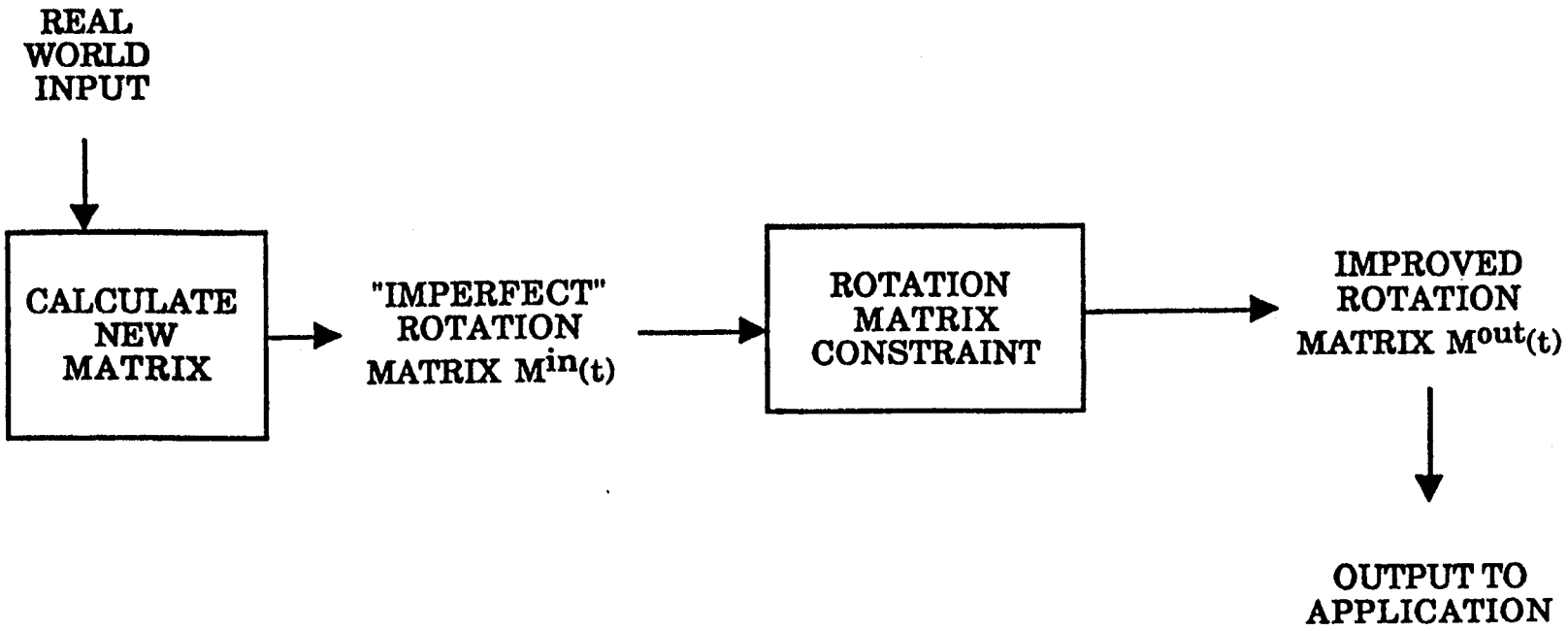

FIG. 8 is a block diagram illustration of an exemplary system utilizing a constraint solution.

DETAILED DESCRIPTION OF THE INVENTION

In the following description for purposes of explanation, numerous details are set forth in order to provide a thorough understanding of the present invention. However, it will be apparent to one skilled in the art that these specific details are required in order to practice the present invention. In other instances, well known electrical structures and circuits are shown in block diagram form in order not to obscure the present invention unnecessarily.

The present invention is directed to a generalized constraint solution technique and method for implementing the same in analog VLSI. The invention will be discussed with respect to producing a three by three rotation matrix containing no scale or skew components. However, it will be apparent to one skilled in the art that the concepts described herein can be applied to other tasks or computations.

Figure 1:
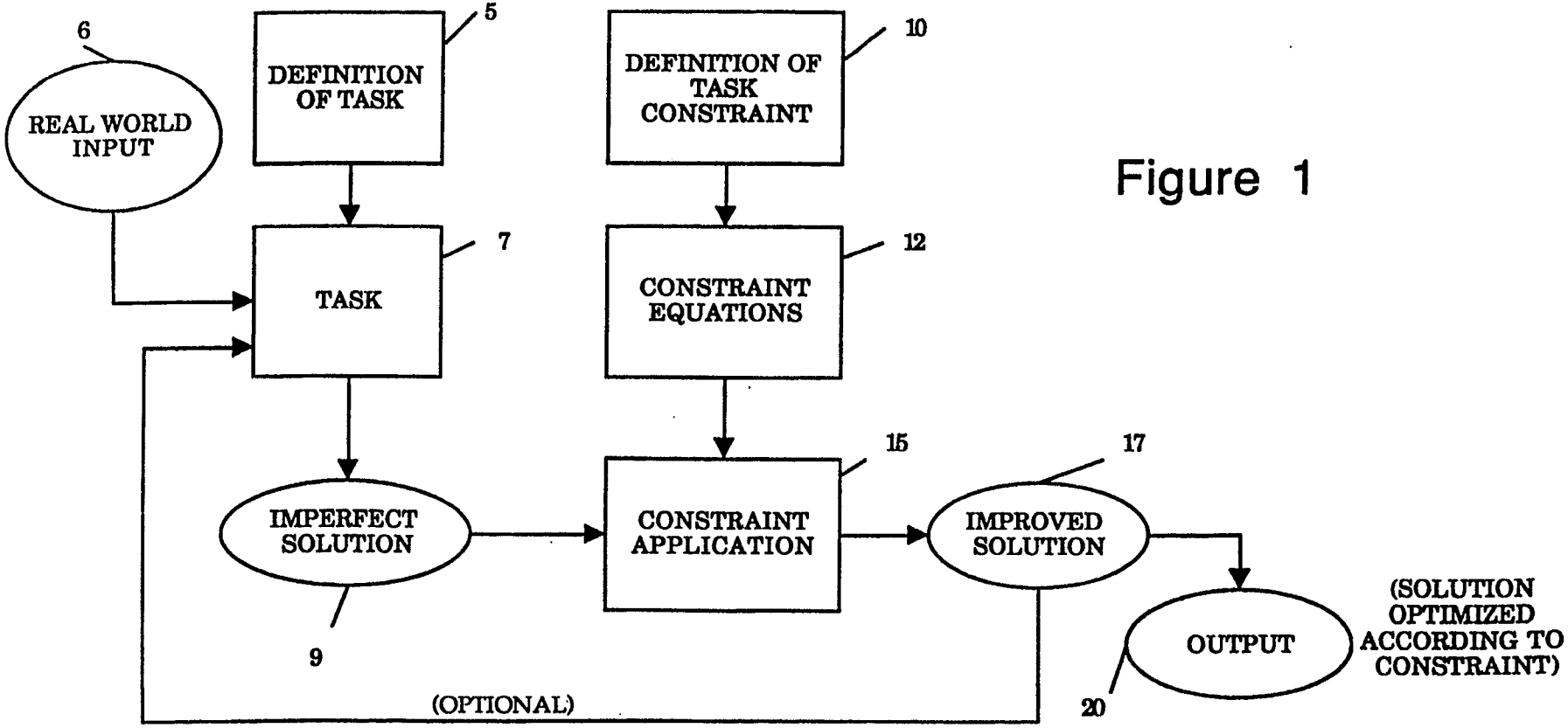
FIG. 1 illustrates a block diagram illustration of a constraint solution process in accordance with the present invention.

A generalized block diagram of the present invention is shown in FIG. 1. The task is defined as a process or computation to be performed, box 5. This is preferably performed manually, although an automated apparatus can be used. A simple illustration would be defining a task which would generate three numbers which add up to a value of 1. Therefore, the task may be defined as the selection of 3 numbers, A, B, and C, such that $A+B+C=1$. Using data input 6, the task is performed, box 7, by an analog or digital apparatus, to generate an imperfect solution 9. For example, if the data input is a set of random numbers selected as the values for the variables A, B, C, it is likely that an imperfect solution is generated.

To generate an improved solution, box 17, the definition of the constraints for the task, box 10, is generated, and constraint equations are formulated, step 12. Although this is preferably accomplished by the user, automated apparatus can also be employed. The constraint equations are then used to enforce the constraint, box 15, to produce an improved solution 17, for output 20. As will be discussed below, it is preferred to implement this process in analog VLSI. Optionally, the improved solution 17 can be utilized to provide error information which is referenced to modify the performance of the task, box 7, to improve the output of the task the next time it is performed.

Typically equations representing constraints of the task can be generated by examining the governing equations which define the task. Ideally, the constraint equations should describe necessary and sufficient conditions under which the results of the computation task are valid. In the simple example described above, the constraint equation that relates to the task is:

$$A+B+C=1$$

A number of different optimization processes known in the art can be used to apply the constraint to generate an improved solution. One such method is gradient descent. To perform gradient descent, a measure of error between the imperfect solution, in the present example the three numbers, and the constraints, is generated in order to calculate a gradient. A gradient descent process to minimize the error measure is then performed to produce new values A', B', C' which satisfy the constraints. The error measure can be determined a number of ways.

A commonly used technique for producing an error measure involves summing the squares of the constraints. Minimizing such an error measure produces a compromise between the various constraints, in the event that they conflict. The square error penalizes large deviations more than small ones.

Therefore, to produce an error measure from the constraint equation, the difference between the desired result and the imperfect solution is squared. Continuing with the simplified example, the error measure E can be defined as:

$$E=(A+B+C-1)^2$$

which should equal zero when the constraint is satisfied.

In order to minimize the error measure, the gradient is used to perform gradient descent. The gradient is calculated from the differentiated error measure function and is used to calculate new parameter values from the prior parameter values. To produce the gradient, the error measure is differentiated. How the error measure changes as the variables A, B, and C are changed will be determined. Therefore, the error measure is differentiated with respect to A, B, and C:

$$\frac{\partial E}{\partial A} = 2(A + B + C - 1)$$

$$\frac{\partial E}{\partial B} = 2(A + B + C - 1)$$

$$\frac{\partial E}{\partial C} = 2(A + B + C - 1)$$

For example, in a discrete gradient descent process, the difference between the gradient multiplied by small step size, $\epsilon$, at each time step is determined:

$$A' = A - \epsilon \frac{\partial E}{\partial A}$$

$$B' = B - \epsilon \frac{\partial E}{\partial B}$$

$$C' = C - \epsilon \frac{\partial E}{\partial C}$$

It should be noted that a different value for $\epsilon$ for each gradient component can be selected, thus choosing a different rate of descent for each variable A, B, and C.

This produces updated values A', B', and C' which then are then substituted back into the gradient equations to determine whether the error measure E is minimized. Therefore, the discrete descent process proceeds iteratively, re-evaluating the gradients at each time step. When the gradient components evaluate to zero, the descent process has reached a local minimum value of the error measure. Minimizing the error measure produces an improved solution.

Preferably, a continuous gradient descent process, such as one implemented by analog VLSI, is utilized. A continuous gradient descent process performs similar steps, but in a continuous and continual manner to minimize the function. Mathematically, a continuous process is defined as a function marked by uninterrupted extension in space, time or sequence having a numerical difference between a value at a point and a nearby point that can be made arbitrarily small as the second point nears the first. A continual process continues indefinitely in time without interruption. Therefore, the process can be envisioned as a discrete process with infinitely small time steps. For an example of a gradient descent process implemented in analog VLSI, see, U.S. patent application Ser. No. 07/981,762 Kirk, et al. "Circuit and Method for Estimating Gradients", filed Nov. 25, 1992.

Figure 2:
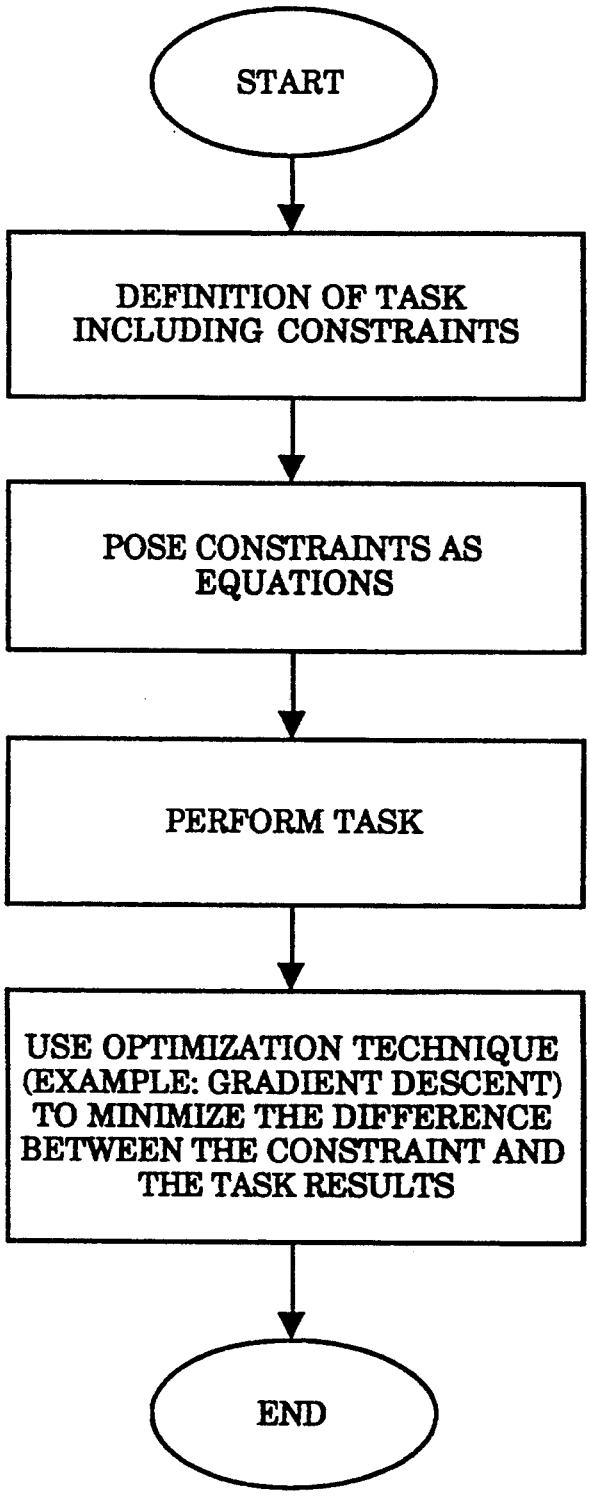
FIG. 2 is a flow chart illustrating the generalized process of the present invention.

A simplified process flow is illustrated by FIG. 2. The task and the constraints for the task are first defined. Furthermore, constraints are posed as equations. The task is performed to produce an imperfect solution, and the optimization process, such as gradient descent, is utilized to minimize the difference between the constraint and the task results.

In the present embodiment, the constraint problem considered is the orthonormalization of a rotation matrix, in particular, a 3×3 matrix. This is quite useful in several applications. For example, for virtual reality applications a sensor may be used to produce a three dimensional orientation in the form of a 3×3 rotation matrix. The sensors are often flawed, noisy, or otherwise inaccurate and do not provide sufficient and reliable information for producing an accurate rotation matrix. In such cases, it is desirable to continuously produce a best estimate rotation matrix based on the sensor measurements. A similar example exists in robotics applications. A sensor can detect the position of an end effector of a robot arm and also measure the control input. In practice, the robot arm is often controlled by providing joint angle control inputs. However, the control may be inaccurate and there may be "slop" in the joints. It may be necessary to then compute an estimate of the actual joint angles which, if the arm segments are rigid, must be pure rotations.

Many applications also exist with respect to physical based modeling. When solving constraint equations for motion of rigid bodies, values may be produced that are inaccurate due to accumulating arithmetic roundoff errors, integration step size or approximations in the model. When combined to form a rotation matrix to describe the orientation of the body, the errors may cause the introduction of scaling or skewing into the matrix. The constraint technique described automatically adjusts for these errors.

The goal is to produce a three by three rotation matrix containing no scale or skew components. Therefore, the problem can be posed mathematically as $MM^T=I$ for a mathematically perfect rotation matrix M where I is the identity matrix. The constraint error function can then be defined as a scalar square of the constraint $MM^T-I=0$:

$$f(M)=(MM^T-I):(MM^T-I),$$

where the double-dot operator (:) denotes the sum of products of terms of the two matrices, producing a scalar result, analogous to the dot product of two vectors. Note that this expression also allows a reflection. Generally, the focus is on situations where the matrix is already "close" to a rotation. When M is a rotation matrix (or reflection), f(M)=0; when M is not purely a rotation matrix, f(M)≠0. Since f(M) is always greater than or equal to zero, M is a rotation matrix when f(M) is minimized. To minimize the function, a gradient descent process is performed, utilizing the function, $$\dot{\underline{M}}(t)=-\epsilon\nabla f(\underline{M}(t))$$

where $\epsilon$ is a parameter or step size which determines the rate of the descent and $\nabla f(\underline{M}(t))$ represents the gradient. In particular, if the expression A:A can be written as:

$$A:A = \sum_{jk} A_{jk}A_{jk},$$

the above constraint equation can be expanded to be:

$$f(\underline{M}) = \sum_{jk}\left(\left(\sum_i M_{ij}M_{ik}\right)-\delta_{jk}\right)\left(\left(\sum_l M_{lj}M_{lk}\right)-\delta_{jk}\right)$$

where $\delta$ represents the Kronecker delta which in this instance is the identity matrix where $\delta_{ij}=1$ when i=j $\delta_{ij}=0$ when i≠j.

In order to use the above equation to enforce a constraint, it should be in a form to permit optimization. Specifically, if gradient descent is to be performed, the gradient must be calculated. The gradient is determined from the differentiated error measure function and is used to determine new parameter values from prior parameter values. To simplify the following discussion, the gradient is computed using Einstein summation notation (ESN). ESN specifies a set of rules for simplifying manipulation of vector expressions. For example, the summation expression is implied in each expression. For further information regarding ESN, see for example, Sokolnikoff, *Mathematical Theory of Elasticity,* 2d.ed., (McGraw-Hill, 1956), and Segel, *Mathematics Applied to Continuum Mechanics/Lee A. Segel; With Material on Elasticity By G. H. Handelman,* (MacMillan 1977). The gradient is therefore defined as:

$$\begin{aligned}\nabla f &= \frac{\partial f}{\partial M_{pq}}\\ &= 2(M_{ij}M_{ik}-\delta_{jk})(\delta_{lp}\delta_{jq}M_{lk}+M_{lj}\delta_{lp}\delta_{qk})\\ &= 4(M_{iq}M_{ik}-\delta_{qk})M_{pk}\end{aligned}$$

This equation can then be used to perform gradient descent to minimize the function f().

$\eta_{pq}$ is defined as the gradient of f():

$$\eta_{pq}=4(M_{iq}M_{ik}-\delta_{qk})M_{pk}$$

The term $M_{iq}M_{ik}$ can be simplified by introducing $\underline{B}_1$ and $\underline{B}_2$ and $\underline{B}_3$ as basis vectors of the matrix $\underline{\underline{M}}$, and Dij as the dot product of $\underline{B}_i$ and $\underline{B}_j$.

$$\begin{aligned}\eta_{pq} &= 4(\underline{B}_q\cdot\underline{B}_k-\delta_{qk})M_{pk}\\ &= 4(D_{qk}-\delta_{qk})M_{pk}\end{aligned}$$

Since the dot products are symmetric, there are only 6 unique $D_{qk}$ terms: the 3 diagonal terms, $D_{11}$, $D_{22}$, and $D_{33}$, and the three unique cross terms, $D_{12}$ (or $D_{21}$), $D_{23}$ ($D_{32}$) and $D_{13}$ ($D_{31}$).

Therefore, the following equation describes a form of the discrete gradient descent process in which the new parameter values are calculated from the prior old parameter values given the gradient components:

$$M_{pq}^{new}=M_{pq}^{old}-\epsilon_{pq}\eta_{pq}$$

The equation describes discrete gradient descent in that each new parameter evaluation and gradient re-evaluation comprises a discrete time step.

The continuous gradient descent process is described by the following differential equation:

$$\frac{\partial M_{pq}(t)}{\partial t} = -\epsilon_{pq}\eta_{pq}(t)$$

The differential value $$\frac{\partial M_{pq}(t)}{\partial t}$$

provides the instantaneous rate of change over time as opposed to discrete time steps. In this form, the time steps are infinitely divisible. This value can be integrated over time to generate the net change:

$$M_{pq}(t) = M_{pq}^{in}(t) - \int^{t} \epsilon_{pq}\eta_{pq}(t)$$

It should be noted that a different value of $\epsilon$ for each component of the gradient can be chosen, thereby selecting a different rate of descent for each matrix component.

The value of 4 from the above discrete equation can be absorbed into $\epsilon$, since $\epsilon$ is an arbitrary constant. Thus, the following set of 9 equations are the components of the gradient:

$$\eta_{11}=(D_{11}-1)M_{11}+D_{12}M_{21}+D_{13}M_{31}$$

$$\eta_{12}D_{21}M_{11}+(D_{22}-1)M_{21}+D_{23}M_{31}$$

$$\eta_{13}=D_{31}M_{11}+D_{32}M_{21}+(D_{33}-1)M_{31}$$

$$\eta_{21}=(D_{11}-1)M_{12}+D_{12}M_{22}+D_{13}M_{32}$$

$$\eta_{22}=D_{21}M_{12}+(D_{22}-1)M_{22}+D_{23}M_{32}$$

$$\eta_{23}=D_{31}M_{12}+D_{32}M_{22}+(D_{33}-1)M_{32}$$

$$\eta_{31}=(D_{11}-1)M_{13}+D_{12}M_{23}+D_{13}M_{33}$$

$$\eta_{32}=D_{21}M_{13}+(D_{22}-1)M_{23}+D_{23}M_{33}$$

$$\eta_{33}=D_{31}M_{13}+D_{32}M_{23}+(D_{33}-1)M_{33}$$

Defining $\underline{B}_1=\underline{X}$, $\underline{B}_2=\underline{Y}$, and $\underline{B}_3=\underline{Z}$, the discrete time step gradient descent optimization can be described as:

$$\underline{X}^{new}=\underline{X}^{old}-\epsilon\eta_{p1}$$

$$\underline{Y}^{new}=\underline{Y}^{old}-\epsilon\eta_{p2}$$

$$\underline{Z}^{new}=\underline{Z}^{old}-\epsilon\eta_{p3}$$

Furthermore, $\eta$ can now be written in terms of $\underline{X}$, $\underline{Y}$, and $\underline{Z}$:

$$\eta_{11}=(D_{11}-1)X_1+D_{12}Y_1+D_{13}Z_1$$

$$\eta_{12}=D_{21}X_1+(D_{22}-1)Y_1+D_{23}Z_1$$

$$\eta_{13}=D_{31}X_1+D_{32}Y_1+(D_{33}-1)Z_1$$

$$\eta_{21}=(D_{11}-1)X_2+D_{12}Y_2+D_{13}Z_2$$

$$\eta_{22}=D_{21}X_2+(D_{22}-1)Y_2+D_{23}Z_2$$

$$\eta_{23}=D_{31}X_2+D_{32}Y_2+(D_{33}-1)Z_2$$

$$\eta_{31}=(D_{11}-1)X_3+D_{12}Y_3+D_{13}Z_3$$

$$\eta_{32}=D_{21}X_3+(D_{22}-1)Y_3+D_{23}Z_3$$

$$\eta_{33}=D_{31}X_3+D_{32}Y_3+(D_{33}-1)Z_3$$

Preferably, the continuous gradient descent process is implemented in an analog VLSI circuit. The analog VLSI circuit will be composed of a nested structured hierarchy of dot products with some additional computation. In particular, the nine input values of the imperfect rotation matrix can be described as three dimensional basis vectors $\underline{X}$, $\underline{Y}$ and $\underline{Z}$ (the three columns of the matrix). The computation of the various components of the gradient $\eta$pq requires dot products of the matrix basis vectors.

Figure 3:
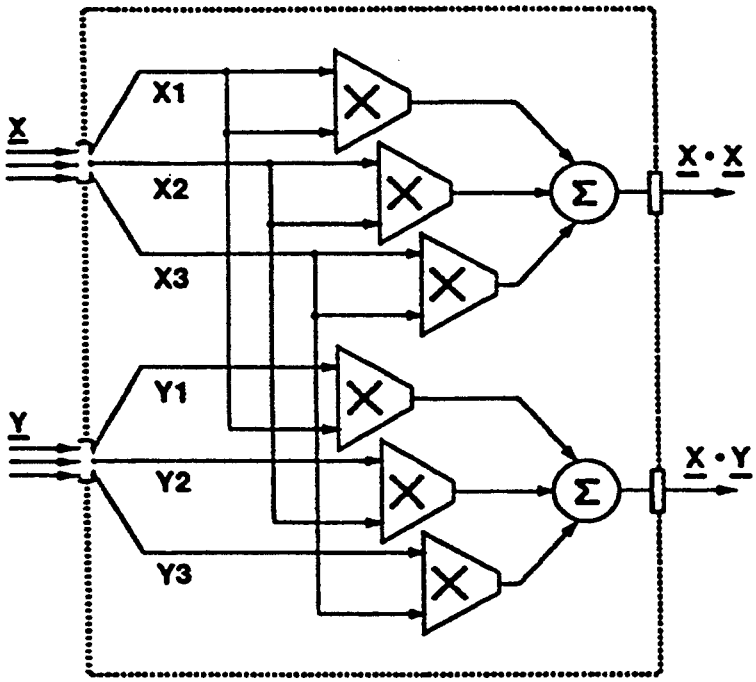
FIG. 3 illustrates a functional block diagram of a circuit which computes two of the dot products utilized in the constraint solution of the preferred embodiment.
Figure 4:
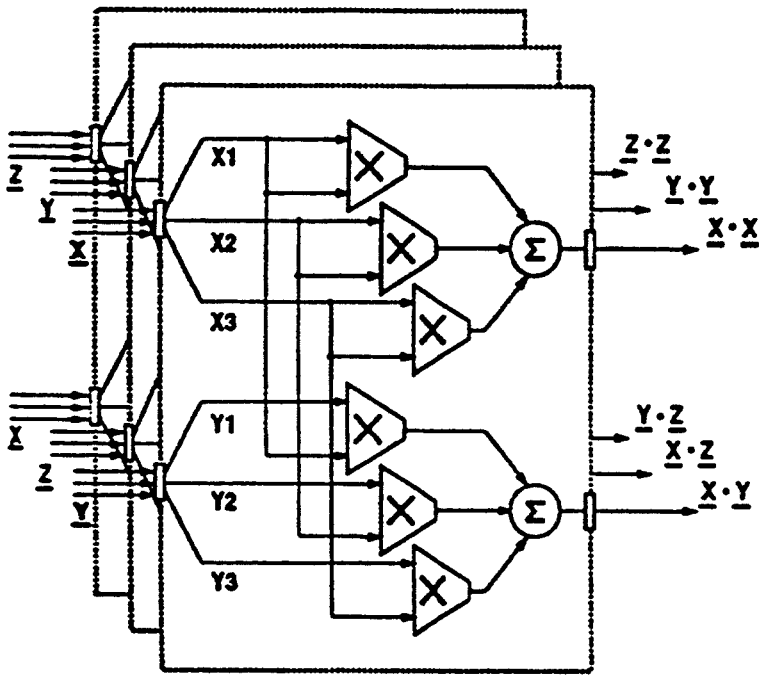
FIG. 4 illustrates a functional block diagram of a circuit which computes the six dot products needed to calculate the gradient components of the preferred embodiment.
Figure 5:
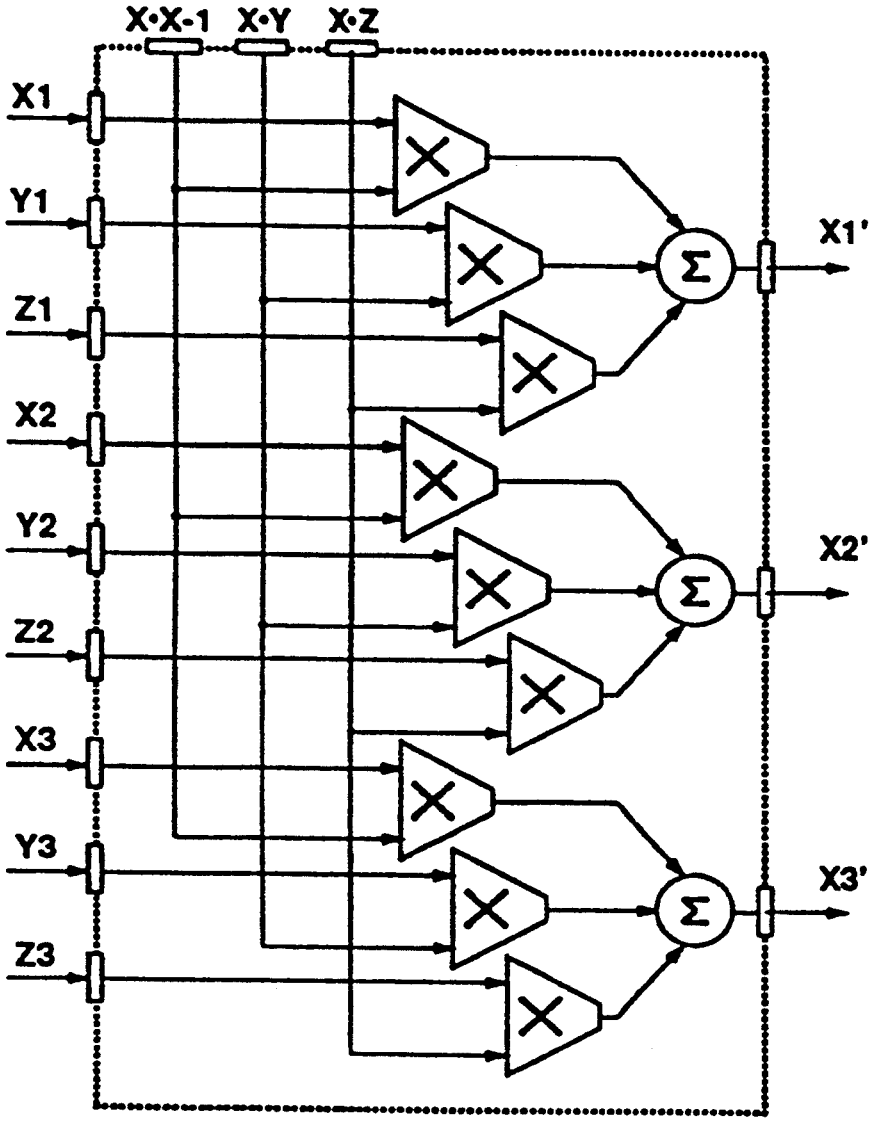
FIG. 5 illustrates a functional block diagram of one constraint block consisting of the basis vector inputs and three of the dot product results to produce gradient components for one of the basis vectors.
Figure 6:
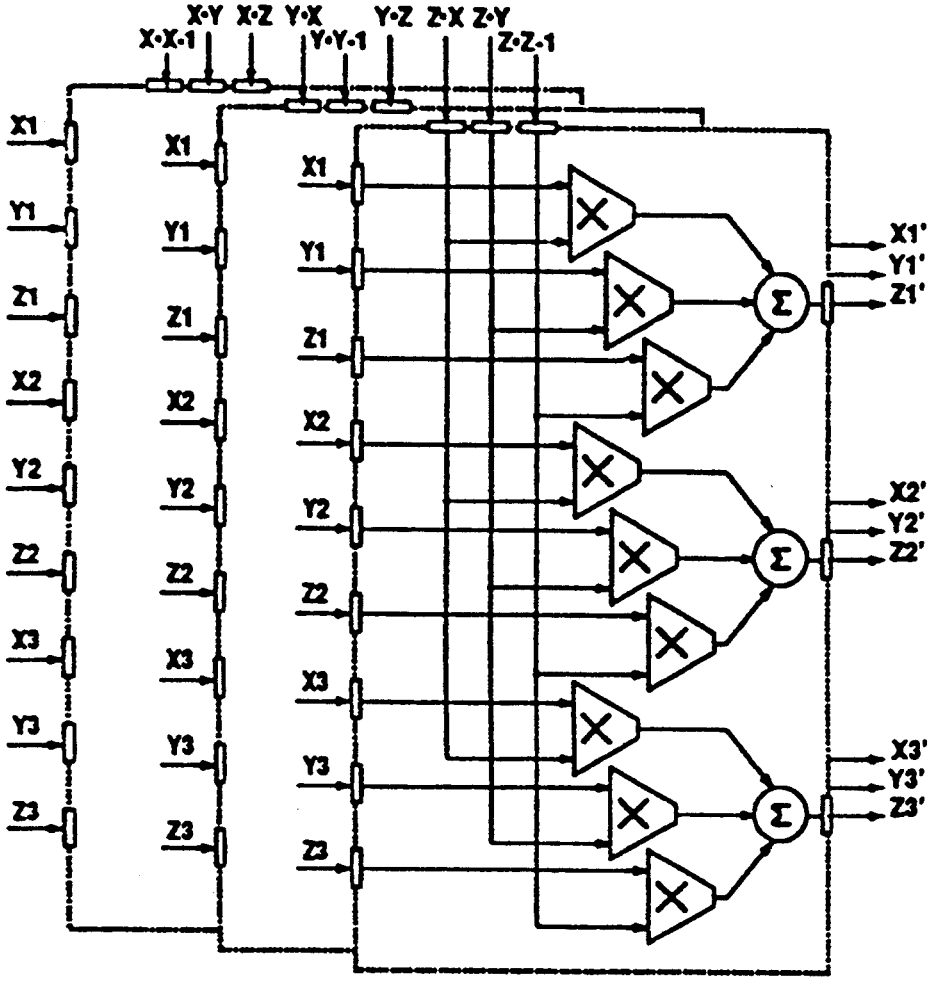
FIG. 6 illustrates a set of three constraint blocks.

FIG. 3 is illustrative of a functional block which computes two of the six basis vector dot products that are required. FIG. 4 shows a set of three functional blocks which together compute the six three dimensional basis vector dot products that are required to form the gradient components $\eta_{pq}$ defined above. FIG. 5 shows the use of the basis vector inputs and three of the dot product results to produce the gradient components for one of the basis vectors, in this case $\underline{X}$. FIG. 6 shows a set of three constraint blocks from FIG. 5, which together compute all the components of the gradient for correction of the imperfect matrix. A combination of these constraint blocks and the three dot products from FIG. 4 forms the gradient calculation hardware. $X'_1$, $X'_2$, $X'_3$, $Y'_1$, $Y'_2$, $Y'_3$, $Z'_1$, $Z'_2$, and $Z'_3$ are the nine derivative components. Together, they form the gradient which is used to optimize the components of the matrix $\underline{M}$. Descending along the direction of the gradient will produce a matrix which fulfills the constraints.

The derivative terms illustrated in FIG. 6 are used to add or subtract from the original values of the matrix M. Since the circuits are analog and operate continuously and continually, these corrections are preferably integrated on capacitors and the gradient components used to set the level of current to add or subtract, in order to update the matrix values. Thus, this circuit structure can be used continuously to track and correct a matrix that changes over time.

Figure 7A:
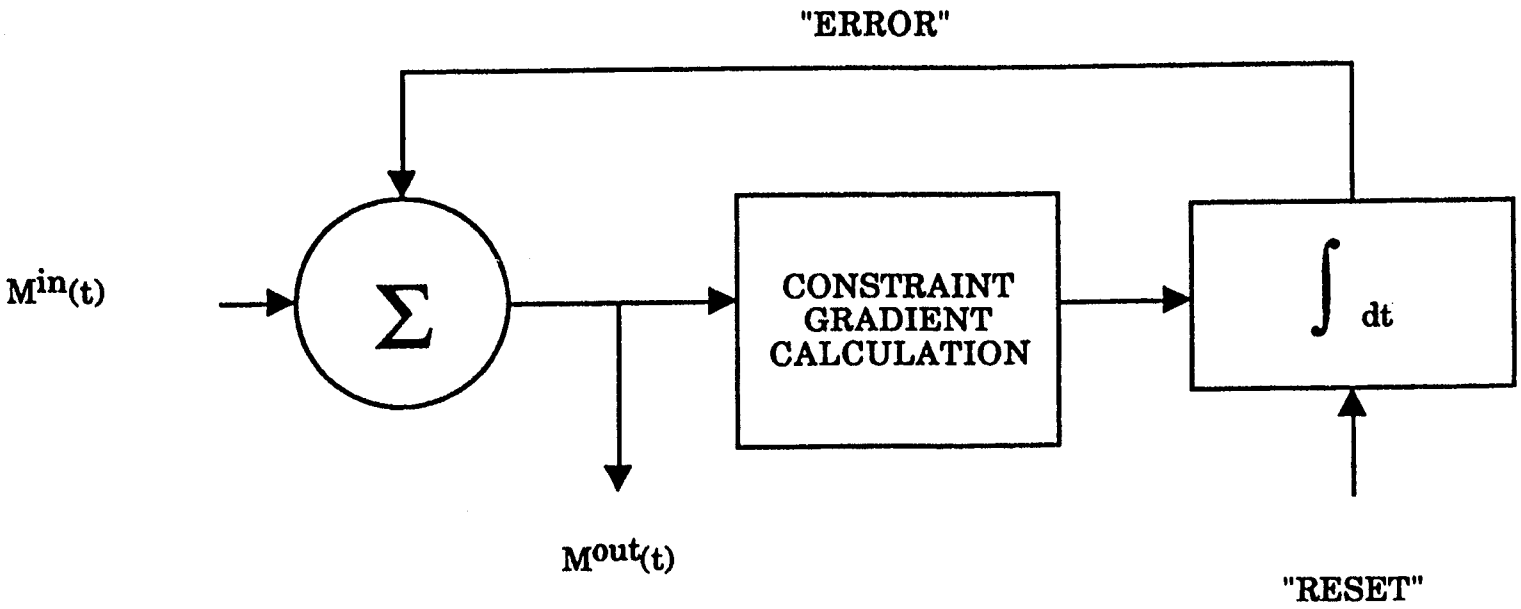
Figure 7B:
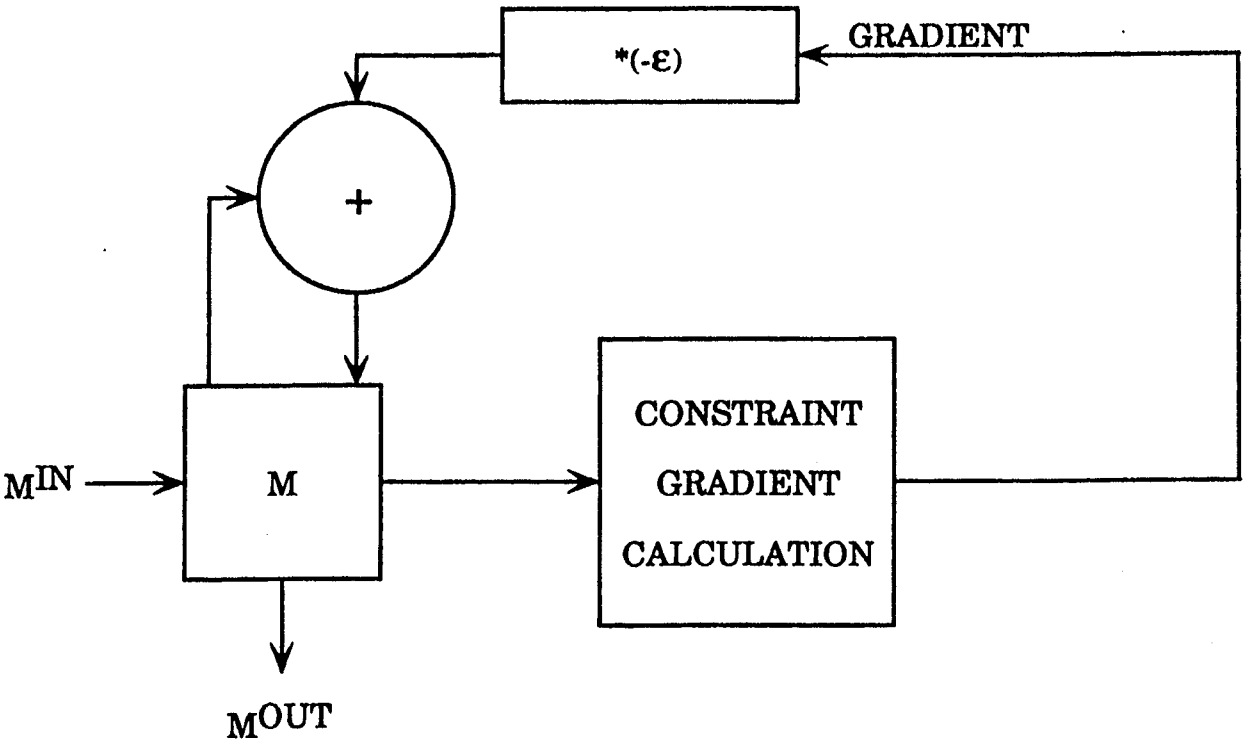

FIG. 7*a* shows in one embodiment the connections required to provide the feedback from the calculated gradient components to modify the input matrix components. The gradient calculation occurs in continuous time using analog VLSI hardware. The input can change continuously or discretely (using the reset input in FIG. 7*a*) and the constraint solution will track the input to correct the matrix. FIG. 7*b* shows an alternate embodiment for a non-continuous implementation. In this embodiment, $M^{in}$ does not change continuously. The value of M is set initially to equal $M^{in}$ and the gradient is subtracted from M iteratively. When the gradient is approximately equal to zero, M is output as $M^{out}$. If this circuit is clocked, the circuit can perform discrete gradient descent. FIG. 8 shows a schematic view of the rotation matrix constraint solution box connected as part of the system. Given a source of approximate rotation matrices, $M^{in}(t)$, the constraint enforcement circuit produces rotation matrices $M^{out}(t)$ which can be used for modeling, rendering, or control applications.

An example of a gradient descent process employed to enforce the rotation matrix constraint is shown in block diagram form in FIG. 7*a*. The feedback from the gradient calculation modifies the effect of inputs to the constraint gradient calculation box. As a constraint is satisfied, the output $M^{out}(t)$ settles to a specific rotation if $M^{in}(t)$ is not changing or is changing at a slower time scale. If the input matrix $M^{in}(t)$ changes discontinuously, the constraint optimization should be started from the new matrix, which can be accomplished using the integration reset input to the circuit.

Thus, the constraint technique for producing orthogonal unit scale rotation matrices from imperfect inputs is described. The technique is potentially useful in a system which produces a sequence of approximate rotation matrices over time. One example of such a system involves producing rotation matrices from approximate inputs from sensors or interactive devices. The system produces approximate rotation matrices over time from angular velocity w(t), according to the following relation:

$$\underline{M}'(t)=\omega x\underline{M}(t)$$

The above equation shows a vector-matrix cross product. By this expression, the following is indicated:

$$M'_{ip}=\sum_{j=1}^{3}\sum_{k=1}^{3}\epsilon_{ijk}\omega_j M_{kp} \qquad i=1,2,3 \qquad p=1,2,3$$

where $\epsilon$ is defined as $$\epsilon_{123}=\epsilon_{231}=\epsilon_{312}=1$$

$$\epsilon_{321}=\epsilon_{213}=\epsilon_{132}=-1$$

for all other i, j, k, $\epsilon_{ijk}=0$

Such a system would produce an approximate rotation matrix at each time step, and may accumulate errors over time. The errors can then be corrected by the constraint technique described herein.

Additional potential applications beyond rotation matrices are readily apparent. Furthermore, the implementation of a nontrivial constraint in analog VLSI has been shown. This implies a future of implementing hardware for modeling in the form of hardware constraint solution. Current digital implementations of constraint systems cannot compute real time constraint solutions for models containing more than a few bodies. The advent of adaptive analog VLSI presents an opportunity to build hardware to accelerate modeling to a level of performance commensurate with that of digital rendering hardware.

The invention has been described in conjunction with the preferred embodiment. It is evident that numerous alternatives, modifications, variations and uses will be apparent to those skilled in the art in light of the foregoing description.

What is claimed is:

1. A system for implementation of real time constraint solution of a task, comprising:

means for defining the task as a first process to be performed;

means for defining constraints of the task;

means for translating the constraints to at least one second process to be solved;

execution means for performing the first process to generate an imperfect solution;

optimization means for minimizing a first difference between the constraints as translated to a second process to be solved and the imperfect solution to produce an improved solution of the task.

2. The system as set forth in claim 1, wherein the means for defining the task defines the task to be a computation to be executed.

3. The system as set forth in claim 1, wherein the means for defining the constraints of the task comprises means for developing constraint equations which describe necessary and sufficient conditions under which the solution of the computation task is valid.

4. The system as set forth in claim 1, wherein the optimization means comprises:

means for generating an error measure;

means for generating a gradient from the error measure;

means for performing a gradient descent process to minimize the error measure;

wherein the output of the minimized error measure provides the improved solution of the task.

5. The system as set forth in claim 4, wherein the means for generating the error measure comprises means for generating the error measure as the square of a second difference between the imperfect solution and the constraints.

6. The system as set forth in claim 4, wherein the means for generating a gradient comprises derivative means for forming the derivative of the error measure.

7. The system as set forth in claim 4, wherein the means for performing a gradient descent process comprises:

means for determining derivative parameter values, which are components of the gradient, corresponding to the partial derivatives of the error measure function with respect to each parameter value; and means for reevaluating the gradient using the derivative parameters to determine if the error measure is at a minimum;

wherein the means for determining and means for reevaluating are iteratively execute until the error measure is at a minimum.

8. The system as set forth in claim 4, wherein the means for performing a gradient descent process comprises:

means for continuously and continually determining derivative parameter values, which are components of the gradient, corresponding to the partial derivatives of the error measure function with respect to each parameter value, also evaluated continuously; and means for evaluating new parameter values continuously corresponding to the difference between the input parameter values and a descent rate parameter multiplied by the gradient components integrated over time;

wherein the means for continuously and continually determining and means for evaluating new parameter values continuously and continually execute until the error measure is at a minimum.

9. The system as set forth in claim 4, wherein the means for generating an error measure generates an error measure using an error function and the means for performing a gradient descent process comprises an analog very large scale integrated (VLSI) circuit which generates derivative parameter values from a second difference of prior parameter values and the gradient multiplied by a step size, and regenerates the gradient, derivative parameter values, using the error measure function differentiated with respect to the parameter values and iteratively performs the gradient descent process until a minimum of the error measure is reached.

10. The system as set forth in claim 4, wherein the means for generating an error measure generates an error measure using an error function and the means for performing a gradient descent process comprises an analog circuit which continuously and continually generates parameter values from a second difference of the input parameter values and a descent rate parameter multiplied by the gradient integrated over time, regenerates the gradient, derivative parameter values, continuously and continually using the error measure function differentiated with respect to the parameter values, and continuously performs the gradient descent process until a minimum of the error measure is reached.

11. The system as set forth in claim 4, wherein the means for generating the error measure comprises an analog very large scale integrated (VLSI) circuit which generates a square of a second difference between the imperfect solution and the constraints.

12. The system as set forth in claim 4, wherein the means for generating a gradient comprises an analog very large scale integrated (VLSI) circuit which computes a derivative of the error measure.

13. The system as set forth in claim 4, wherein the means for performing a gradient descent process descends with respect to different parameters at different rates to minimize the error measure.

14. A process for constructing an analog very large scale integrated (VLSI) circuit for the real time solution of a task, comprising the steps of:

defining the task as a first process to be performed;

defining constraints of a task as at least one second process to be solved;

performing the first process to generate an imperfect solution;

specifying an error measure between the imperfect solution and the constraints;

generating a representation of a gradient from the error measure of the first and second process; and translating the gradient into analog circuit components which perform a gradient descent process an analog circuit which receive as input the imperfect solution and performs gradient descent to minimize the error measure to generate as output an improved solution.

15. The process as set forth in claim 14, wherein the gradient descent process is a discrete process and gradient descent is iteratively performed to minimize the error measure.

16. The process as set forth in claim 15, wherein the gradient descent process is a continuous process and gradient descent is continuously and continually performed to minimize the error measure.

17. The process as set forth in claim 14, wherein the step of generating the gradient comprises the step of generating the measure of error as a square of a difference between the imperfect solution and the constraints.

18. The process as set forth in claim 17, wherein the step of translating the gradient comprises the step of defining the gradient descent according to the following equation:

$$\text{Task}'(t) = -\epsilon \nabla f(\text{Task}(t))$$

where Task(t) is the result of the first process to be performed at time t, Task'(t) represents the derivative of the result of the task, $\epsilon$ represents a rate of the descent and $\nabla f$ is the gradient of the error measure, f, given the result at the time t, of Task(t).

19. An analog very large scale integrated (VLSI) circuit for the implementation of a $3 \times 3$ rotation matrix constraint, an input matrix comprises elements $X_1$, $X_2$, $X_3$, $Y_1$, $Y_2$, $Y_3$, $Z_1$, $Z_2$, and $Z_3$, said circuit comprising:

three basis vector constraint blocks, each block implementing a rotation matrix constraint for one of three matrix column vectors, each block receiving as input the matrix elements $X_1$, $X_2$, $X_3$, $Y_1$, $Y_2$, $Y_3$, $Z_1$, $Z_2$, and $Z_3$ and dot products of the matrix elements and outputting derivative matrix elements $X_1'$, $X_2'$, $X_3'$, $Y_1'$, $Y_2'$, $Y_3'$, $Z_1'$, $Z_2'$, and $Z_3'$ which form the gradient, said derivative matrix elements representative of the instantaneous rate of change in value of the matrix elements in order to minimize the constraint error measure;

integrators to integrate the derivative matrix elements to form an output comprising corrective inputs to the input matrix such that if the error measure is minimized the input to the integrator is approximately zero;

a combining means coupled to receive the output of the integrators and the input matrix elements prior to input to the three basis vector constraint blocks, said combining means combining the output of the integrators and the input matrix elements to produce an output coupled to the input to the three basis vector constraint blocks;

wherein the circuit continuously and continually tracks and corrects the input matrix when it changes over time.

20. The analog VLSI circuit as set forth in claim 19, wherein the rotation matrix constraint is equal to $MM^T = I$ wherein M represents the matrix and $M^T$ represents the transposed matrix.

21. The analog VLSI circuit as set forth in claim 20, wherein the gradient f is defined to be equal to $\epsilon(M_{iq}M_{lk}-\delta_{qk})M_{pk}$ wherein $\delta$ represents the identity matrix $\delta$ represents a constant, and iq, lk, qk and pk identify locations in the matrix.

22. The analog circuit as set forth in claim 21, wherein the gradient of the matrix is computed according to the following:

$$\eta_{11} = (D_{11}-1)M_{11} + D_{12}M_{21} + D_{13}M_{31}$$

$$\eta_{12} D_{21}M_{11} + (D_{22}-1)M_{21} + D_{23}M_{31}$$

$$\eta_{13} = D_{31}M_{11} + D_{32}M_{21} + (D_{33}-1)M_{31}$$

$$\eta_{21} = (D_{11}-1)M_{12} + D_{12}M_{22} + D_{13}M_{32}$$

$$\eta_{22} = D_{21}M_{12} + (D_{22}-1)M_{22} + D_{23}M_{32}$$

$$\eta_{23} = D_{31}M_{12} + D_{32}M_{22} + (D_{33}-1)M_{32}$$

$$\eta_{31} = (D_{11}-1)M_{13} + D_{12}M_{23} + D_{13}M_{33}$$

$$\eta_{32} = D_{21}M_{13} + (D_{22}-1)M_{23} + D_{23}M_{33}$$

$$\eta_{33} = D_{31}M_{13} + D_{32}M_{23} + (D_{33}-1)M_{33}$$

wherein $\eta_{11}$-$\eta_{33}$ represent the gradient matrix elements; $D_{qr}$ represents the dot product of matrix column vectors $\underline{B_q}$ and $\underline{B_r}$; and $\underline{B_q}$ and $\underline{B_r}$ represent basis vectors of the matrix.

* * * * *

UNITED STATES PATENT AND TRADEMARK OFFICE

CERTIFICATE OF CORRECTION

PATENT NO. : 5,381,361

DATED : January 10, 1995

INVENTOR(S) : Kirk et al.

It is certified that error appears in the above-identified patent and that said Letters Patent is hereby corrected as shown below:

In item

[57] ABSTRACT at line 7 change "described" to --describes--;

at lines 7-8 change "stisfied." to --satisfied--.

Signed and Sealed this

Twenty-fourth Day of October, 1995

Bruce Lehman

*Attest:*

BRUCE LEHMAN

*Attesting Officer*

*Commissioner of Patents and Trademarks*